US008967754B2

(12) United States Patent
Yano

(10) Patent No.: US 8,967,754 B2
(45) Date of Patent: Mar. 3, 2015

(54) PRINTING APPARATUS, CONTROL METHOD THEREOF, AND STORAGE MEDIUM

(71) Applicant: Canon Kabushiki Kaisha, Tokyo (JP)

(72) Inventor: Takaaki Yano, Tokyo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/914,796

(22) Filed: Jun. 11, 2013

(65) Prior Publication Data

US 2013/0335475 A1 Dec. 19, 2013

(30) Foreign Application Priority Data

Jun. 14, 2012 (JP) ..... 2012-135125

(51) Int. Cl.
*B41J 29/38* (2006.01)
*B41J 13/00* (2006.01)

(52) U.S. Cl.
CPC ..... *B41J 13/0009* (2013.01)
USPC ..... 347/16

(58) Field of Classification Search
CPC ... B41J 13/0009; G06F 3/1237; G06K 15/16; G06K 15/1805
USPC ..... 347/16, 101, 104–106; 271/275, 276; 358/1.14, 1.15
See application file for complete search history.

(56) References Cited

U.S. PATENT DOCUMENTS 8,482,759 B2 * 7/2013 Utsunomiya ..... 358/1.15
2007/0279673 A1 12/2007 Utsunomiya

FOREIGN PATENT DOCUMENTS

JP 2007-320247 A 12/2007

* cited by examiner

*Primary Examiner* — An Do
(74) *Attorney, Agent, or Firm* — Rossi, Kimms & McDowell LLP

(57) ABSTRACT

A printing apparatus according to one aspect of the present invention sets a printing condition, which specifies a condition for permitting printing using a sheet, for that sheet in accordance with an instruction from a user. The printing apparatus then decides on a sheet feed tray, from a plurality of sheet feed units, for which printing using the sheet contained in the sheet feed unit is permitted, as a sheet feed source, based on the printing condition and printing settings including a setting regarding the sheet feed source for the sheet to be used in a print job. Furthermore, the printing apparatus executes the print job using the sheet contained in the sheet feed tray that has been decided on.

10 Claims, 12 Drawing Sheets

| SHAPE | SURFACE PROPERTY | BASIS WEIGHT(g/m2) | | |
|---|---|---|---|---|
| | | 60~80 | 81~100 | 101~200 |
| NORMAL | HIGH-QUALITY | THIN PAPER | NORMAL PAPER | THICK PAPER |
| | RECYCLED | RECYCLED PAPER | | |
| | COATED | COATED PAPER 1 | COATED PAPER 2 | |
| | TRANSPARENT | FILM | | |
| TABBED | HIGH-QUALITY | TABBED PAPER 1 | TABBED PAPER 2 | |

FIG. 4

| PAPER SIZE | PAPER TYPE | DOUBLE-SIDED PRINTING OK | SHEET FEED SOURCE | | | DISCHARGE DESTINATION | | |
|---|---|---|---|---|---|---|---|---|
| | | | SHEET FEED TRAY 1 | SHEET FEED TRAY 2 | MANUAL FEED | DISCHARGE TRAY | CASE-BINDING DEVICE | TRIMMING DEVICE |
| A4 | THIN PAPER | ○ | ○ | ○ | ○ | ○ | ○ | × |
| | NORMAL PAPER | ○ | ○ | ○ | ○ | ○ | ○ | × |
| | THICK PAPER | × | ○ | ○ | ○ | ○ | × | × |
| | RECYCLED PAPER | ○ | ○ | ○ | ○ | ○ | ○ | × |
| | COATED PAPER 1 | ○ | ○ | ○ | ○ | ○ | ○ | × |
| | COATED PAPER 2 | × | ○ | ○ | ○ | ○ | × | × |
| | TABBED PAPER 1 | ○ | × | × | ○ | ○ | × | × |
| | TABBED PAPER 2 | × | × | × | ○ | ○ | × | × |
| A3 | THIN PAPER | ○ | ○ | ○ | ○ | ○ | ○ | ○ |
| | NORMAL PAPER | ○ | ○ | ○ | ○ | ○ | ○ | ○ |
| | THICK PAPER | × | ○ | ○ | ○ | ○ | × | ○ |
| | RECYCLED PAPER | ○ | ○ | ○ | ○ | ○ | ○ | ○ |
| | COATED PAPER 1 | ○ | ○ | ○ | ○ | ○ | ○ | ○ |
| | COATED PAPER 2 | × | ○ | ○ | ○ | ○ | × | ○ |
| | TABBED PAPER 1 | ○ | × | × | ○ | ○ | × | × |
| | TABBED PAPER 2 | × | × | × | ○ | ○ | × | × |

FIG. 5

| SHEET NAME | ATTRIBUTES | BASIS WEIGHT | SURFACE PROPERTY | COLOR | CONDITIONS |
|---|---|---|---|---|---|
| NORMAL PAPER | BASIC SHEET | 81g/m2 | HIGH-QUALITY PAPER | WHITE | NO RESTRICTIONS |
| COATED PAPER 1 | BASIC SHEET | 75g/m2 | SINGLE-SIDED COATING | WHITE | NO RESTRICTIONS |
| ⋮ | ⋮ | ⋮ | ⋮ | ⋮ | ⋮ |
| ABC Paper Plain | USER DESIGNATED | 90g/m2 | HIGH-QUALITY PAPER | WHITE | COLOR |
| ABC Paper Coated | USER DESIGNATED | 92g/m2 | SINGLE-SIDED COATING | CREAM | COLOR |
| ABC Paper Label | USER DESIGNATED | 150g/m2 | LABEL | YELLOW | NO RESTRICTIONS |
| DEF Company Plain | USER DESIGNATED | 98g/m2 | HIGH-QUALITY PAPER | GRAY | MONOCHROME |
| DEF Company Coated | USER DESIGNATED | 120g/m2 | DOUBLE-SIDED COATING | WHITE | COLOR |
| ⋮ | ⋮ | ⋮ | ⋮ | ⋮ | ⋮ |
| XYZ Paper Recycle | USER DESIGNATED | 100g/m2 | RECYCLED PAPER | WHITE | MONOCHROME |

PRINTING APPARATUS, CONTROL METHOD THEREOF, AND STORAGE MEDIUM

BACKGROUND OF THE INVENTION

1. Field of the Invention

The present invention relates to printing apparatuses, control methods thereof, and storage media.

2. Description of the Related Art

The printing that can be executed by image forming apparatuses such as printing apparatuses (printers) generally has restrictions depending on the type of sheet (printing sheet); for example, the execution of double-sided printing is restricted in the case of printing sheets with high basis weight, such as thick paper, coated paper, and so on. For such cases, a technique that prevents the designation of printing settings that execute printing restricted due to the structure of a printing apparatus, such as preventing a double-sided printing setting in the case where thick paper has been designated as a printing sheet setting, is known (for example, see Japanese Patent Laid-Open No. 2007-320247).

In environments where many users share a printing apparatus, such as office environments and the like, the purpose of printed material and the desired quality of the printed material will differ from user to user. In such an environment, a printing apparatus that includes a plurality of sheet feed trays is provided, and various types of printing sheets are contained in the different sheet feed trays. This enables users to designate one of the sheet feed trays and obtain the desired printed material. However, when causing the printing apparatus to execute a print job, it is difficult for the user to know ahead of time what type of printing sheets are contained in each sheet feed tray of the printing apparatus. Accordingly, by designating a printing sheet type (and size) for a print job and setting the printing apparatus to automatically select the sheet feed tray, printing can be carried out using the designated type (and size) of printing sheet.

In the case where the printing apparatus is set to automatically select a sheet feed tray for a print job, the printing apparatus automatically selects, for example, the sheet feed tray that contains the printing sheets corresponding to the type (and size) of the printing sheet designated in the print job, and executes the printing. In the case where a plurality of sheet feed trays that contain the printing sheets of the type (and size) designated in the printing settings are present, the printing apparatus can select, for example, the sheet feed tray having the lowest number out of numbers assigned to the sheet feed trays, or the sheet feed tray that takes the least amount of time to feed paper, as the sheet feed source of the printing sheets.

In such a case, the sheet feed tray that contains the printing sheets that correspond to the printing settings in the print job will not necessarily be selected as appropriate. For example, in the case where double-sided printing has been set, it is possible, due to the structure of the printing apparatus, that a sheet feed tray containing printing sheets not suited to double-sided printing will be selected as the sheet feed source of the printing sheets.

SUMMARY OF THE INVENTION

The present invention has been achieved in light of the above-mentioned problems. The present invention provides a technique for a printing apparatus to more appropriately select a sheet feed unit (sheet feed tray) that corresponds to a printing setting and execute a print job, even in the case where the sheet feed tray is automatically to be selected.

According to one aspect of the present invention, there is provided a printing apparatus capable of feeding sheets from a plurality of sheet feed units, the apparatus comprising: a setting unit configured to set a printing condition, which specifies a condition for permitting printing using a sheet, for that sheet in accordance with an instruction from a user; an extracting unit configured to extract, from a print job, printing settings including a setting regarding a sheet feed source of a sheet to be used in the print job; a deciding unit configured to decide on a sheet feed unit, from the plurality of sheet feed units, for which printing using the sheet contained in the sheet feed unit is permitted, as the sheet feed source, based on the printing condition and the printing settings; and an executing unit configured to execute the print job using the sheet contained in the sheet feed unit that has been decided on.

According to another aspect of the present invention, there is provided a control method for a printing apparatus capable of feeding sheets from a plurality of sheet feed units, the method comprising steps of: setting a printing condition, which specifies a condition for permitting printing using a sheet, for that sheet in accordance with an instruction from a user; extracting, from a print job, printing settings including a setting regarding a sheet feed source of the sheet to be used in the print job; deciding on a sheet feed unit, from the plurality of sheet feed units, for which printing using the sheet contained in the sheet feed unit is permitted, as the sheet feed source, based on the printing condition and the printing settings; and executing the print job using the sheet contained in the sheet feed unit that has been decided on.

According to still another aspect of the present invention, there is provided a computer-readable storage medium storing a computer program for causing a computer to execute steps of a control method for a printing apparatus capable of feeding sheets from a plurality of sheet feed units, the method comprising steps of: setting a printing condition, which specifies a condition for permitting printing using a sheet, for that sheet in accordance with an instruction from a user; extracting, from a print job, printing settings including a setting regarding a sheet feed source of the sheet to be used in the print job; deciding on a sheet feed unit, from the plurality of sheet feed units, for which printing using the sheet contained in the sheet feed unit is permitted, as the sheet feed source, based on the printing condition and the printing settings; and executing the print job using the sheet contained in the sheet feed unit that has been decided on.

According to the present invention, it is possible to provide a technique for a printing apparatus to more appropriately select a sheet feed tray that corresponds to a printing setting and execute a print job, even in the case where the sheet feed unit is automatically selected.

Further features of the present invention will become apparent from the following description of exemplary embodiments (with reference to the attached drawings).

BRIEF DESCRIPTION OF THE DRAWINGS

FIG. 4 is a diagram illustrating an example of information regarding printing functions corresponding to sheet sizes and sheet types that are set in the printing apparatus 110 according to the first embodiment of the present invention.

FIG. 5 is a diagram illustrating an example of information registered in a media library 204 that is set and managed by the printing apparatus 110 according to the first embodiment of the present invention.

DESCRIPTION OF THE EMBODIMENTS

Hereinafter, embodiments of the present invention will be described with reference to the drawings. It should be noted that the following embodiments are not intended to limit the scope of the appended claims, and that not all the combinations of features described in the embodiments are necessarily essential to the solving means of the present invention.

First Embodiment

Hardware Configuration of Printing Apparatus 110

Figure 1:
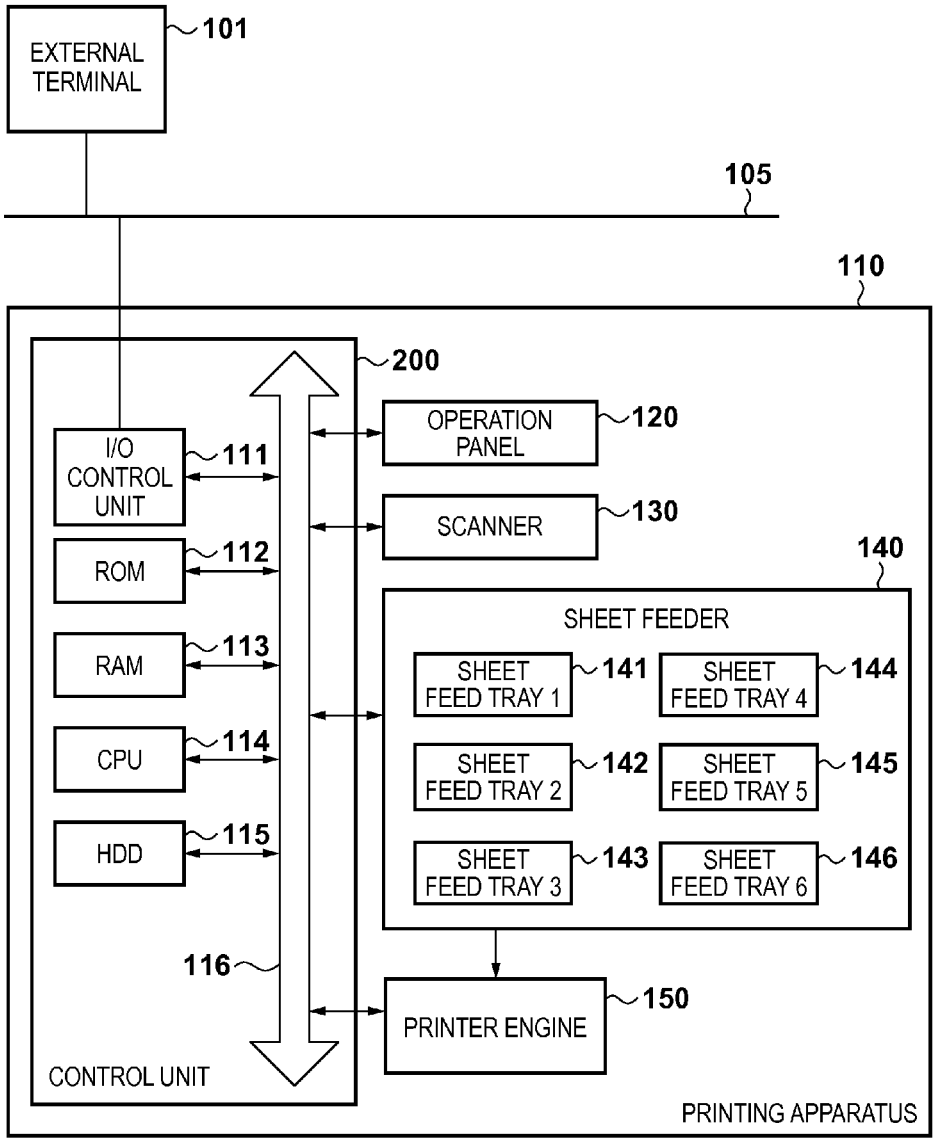
FIG. 1 is a block diagram illustrating the overall hardware configuration of a printing apparatus 110 according to a first embodiment of the present invention.

First, a first embodiment of the present invention will be described with reference to FIGS. 1 through 13. FIG. 1 is a block diagram illustrating the overall hardware configuration of the printing apparatus 110 according to the present embodiment. The printing apparatus 110 is connected to a communication line 105 such as a LAN or the like. The communication line 105 is also connected to an external terminal 101. The external terminal 101 and the printing apparatus 110 are connected to each other via the communication line 105, and are capable of communicating with each other via the communication line 105. Note that other external terminals aside from the external terminal 101 may be connected to the communication line 105. By connecting their own personal computers to the communication line 105 as external terminals, many users can access the printing apparatus 110 from their external terminals via the communication line 105.

The external terminal 101 can receive an input from a user via an input device (not shown) and can send a print job generated in accordance with that input to the printing apparatus 110 via the communication line 105.

The printing apparatus 110 includes a control unit 200, as well as an operation panel 120, a scanner 130, a sheet feeder 140, and a printer engine 150 that are connected to the control unit 200. The control unit 200 controls the overall operations of the printing apparatus 110 by performing various types of data processes. The operation panel 120 accepts various types of operations performed by the user through a user interface (UI) such as a touch panel or the like. The scanner 130 reads an image of a document using an optical sensor and generates image data corresponding to the read image. The sheet feeder 140 is a sheet feeding device that includes a plurality of sheet feed trays (sheet feed units) that each contain printing sheets (sheets) used in printing. The printer engine 150 prints an image based on the image data on the printing sheets.

The control unit 200 includes an input/output (I/O) control unit 111, a ROM 112, a RAM 113, a CPU 114, and an HDD 115, and these modules are connected to each other via a system bus 116 within the control unit 200. The I/O control unit 111 controls communication with an external network. The ROM 112 holds various types of control programs. The RAM 113 holds control programs that are read out from the ROM 112 by the CPU 114. The CPU 114 performs overall control of the devices within the printing apparatus 110 by executing the control programs held in the RAM 113. The HDD 115 is used to save large pieces of data, such as image data, print data, and the like, temporarily or for long periods of time. The system bus 116 connects the control unit 200 to the respective devices provided outside of the control unit 200.

Note that the RAM 113 is also used as a main memory or a working memory for the CPU 114. In addition, control programs and an operating system may be held in the HDD 115 in addition to the ROM 112. Furthermore, the printing apparatus 110 may include NVRAM (not shown), and setting information of the printing apparatus 110 sent from the operation panel 120 to the control unit 200 may be held in the NVRAM.

The sheet feeder 140 includes the plurality of sheet feed trays (sheet feed units, sheet holding units). In addition to the sheet feed trays provided in the printing apparatus 110 itself, the sheet feeder 140 may include, as optional items, other sheet feed trays such as an external sheet feed tray, a manual sheet feed tray, or the like. In the present embodiment, a total of six sheet feed trays consisting of sheet feed trays 141 to 146 (respectively called sheet feed trays 1 to 6 hereinafter) are provided in the sheet feeder 140. Each sheet feed tray is capable of containing printing sheets. As will be described later, when the printing sheets contained in a given sheet feed tray are permitted to be used according to printing conditions that have been set, those printing sheets are conveyed to the printer engine 150 and are used in printing.

(Software Configuration of Printing Apparatus 110)

Figures 2, 3:
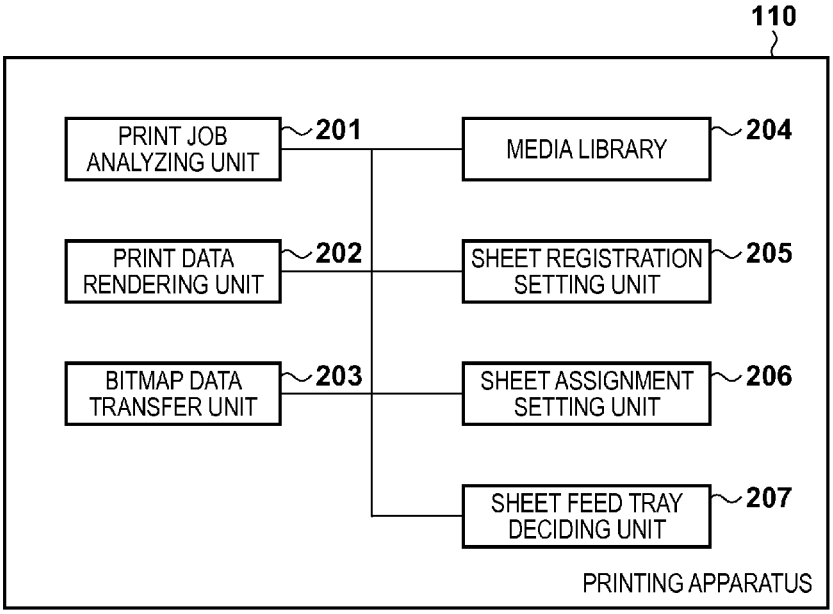
FIG. 2 is a block diagram illustrating the overall software configuration of the printing apparatus 110 according to the first embodiment of the present invention.
FIG. 3 is a diagram illustrating an example of information regarding printing sheet types (sheet types) that are set in the printing apparatus 110 according to the first embodiment of the present invention.

FIG. 2 is a block diagram illustrating the overall software configuration of the printing apparatus 110 according to the present embodiment. The functions of the software modules illustrated in FIG. 2 are realized in the printing apparatus 110 by the CPU 114 reading out programs held in the ROM 112 or the HDD 115 to the RAM 113 and executing those programs.

In other words, the CPU 114 executes the functions of the respective software modules shown in FIG. 2 by executing those software modules.

A print job analyzing unit 201 analyzes various types of print jobs accepted by the printing apparatus 110, such as print jobs sent from the external terminal 101, copy jobs generated by the printing apparatus 110, and the like, and extracts printing settings contained in those print jobs. For example, the following settings are included in the printing settings in the present embodiment.

- the size of the printing sheet used in the printing (the sheet size)
- the type of the printing sheet used in the printing (the sheet type)
- settings regarding the sheet feed source (auto select or a designation of one of the sheet feed trays)
- settings regarding a discharge destination (a discharge tray or a finishing device)
- settings for multicolor printing or black-and-white (monochrome) printing
- settings for single-sided printing or double-sided printing
- settings regarding functions to be executed such as image processing or the like The printing settings extracted from the print job by the print job analyzing unit 201 are temporarily saved in the RAM 113 or the HDD 115. Note that the size and type of the printing sheets are examples of printing sheet properties.

A print data rendering unit 202 renders print data included in the print job accepted by the printing apparatus 110 as image data (bitmap data) that can be used in printing by the printer engine 150. Print data received from the external terminal 101 is normally written in page description language (PDL) or the like. Accordingly, the print data rendering unit 202 renders the print data written in PDL as bitmap data. In the case where the print data is already rendered as bitmap data by the external terminal 101 or the like, the print data rendering unit 202 performs only a color conversion process for converting the bitmap data into data in a color space supported by the printer engine 150. Meanwhile, in the case where a copy job is generated by the printing apparatus 110, the print data rendering unit 202 renders image data generated by the scanner 130 as bitmap data. The bitmap data generated by the print data rendering unit 202 is temporarily saved in the RAM 113 or the HDD 115.

A bitmap data transfer unit 203 transfers the bitmap data saved in the RAM 113 or the HDD 115 to the printer engine 150 in accordance with the timing at which printing is executed by the printer engine 150.

A media library 204 corresponds to a database for managing sheet information, which in turn corresponds to information regarding the printing sheets (sheets) handled by the printing apparatus 110. This database is stored in the HDD 115. As will be described later, the sheet information includes printing conditions that define conditions for permitting printing that uses the corresponding printing sheets. Meanwhile, the CPU 114 reads out information (included in the database) managed by the media library 204 from the HDD 115, and writes the information to the HDD 115 in order to register that information in the media library 204 (database). Information regarding generally-used printing sheets is registered in the media library 204 in advance when the printing apparatus 110 is shipped.

A sheet registration setting unit 205 enables a user to add, delete, or edit sheet information as necessary via the operation panel 120, and manipulates the media library 204 based on information input via the operation panel 120.

A sheet assignment setting unit 206 assigns the sheet information set by the sheet registration setting unit 205 and contained in the media library 204 to the respective sheet feed trays 1 to 6 in the sheet feeder 140. Specifically, the sheet assignment setting unit 206 assigns the sheet information in the media library 204 to respective sheet feed trays in accordance with a selection made by the user via the operation panel 120. Through this, the sheet information corresponding to the printing sheets inserted by the user is assigned to the respective sheet feed trays.

A sheet feed tray deciding unit 207 selects a sheet feed tray to serve as a sheet feed source of the printing sheets used in printing according to the print job, based on the printing settings extracted by the print job analyzing unit 201 and the sheet information registered in the media library 204. In the case where the sheet feed source setting included in the printing settings is set to "auto select" for automatically selecting the sheet feed source of the printing sheets to be used in the print job, the sheet feed tray deciding unit 207 selects the sheet feed tray to be used as the sheet feed source from the sheet feed trays 1 to 6 through a procedure described later (see FIG. 13). The printing sheets contained in the sheet feed tray decided by the sheet feed tray deciding unit 207 are conveyed to the printer engine 150 in accordance with the timing of the printing and are then printed upon.

(Sheet Information Setting)

Next, a process for setting the sheet information that includes the printing conditions, executed by the sheet registration setting unit 205 in the printing apparatus 110, will be described with reference to FIGS. 3 through 8.

Generally, there are restrictions on the types of printing sheet that can be used in an image forming apparatus such as the printing apparatus 110. With the printing apparatus 110 according to the present embodiment, the type of printing sheet that can be fed, conveyed, and used in printing is determined by the structure (physical restrictions) of the printer engine 150, the sheet feeder 140, and a discharge unit (not shown). Normally, the printing sheets that can be printed on are specified for each image forming apparatus by the manufacturer. In the case where printing sheets aside from the specified printing sheets are used in an image forming apparatus, there is a possibility that the printing results desired by the user will not be obtained, the printing sheets will become jammed in the apparatus, or the apparatus itself will malfunction.

FIG. 3 is an example of information regarding the type of the printing sheets, set in the printing apparatus 110. This information is stored in the ROM 112 or the HDD 115, and is read out to the RAM 113 and used by the CPU 114 as necessary. Here, the sheet type is set based on information such as, for example, the shape of the printing sheet, surface properties, and a basis weight indicating how heavy the printing sheet is, but the present invention is not limited only to the information shown in FIG. 3. Note that the "surface properties" refers to properties of the surface of the printing sheet, such as high-quality, recycled paper, single-sided coating, film, or the like, as shown in FIG. 3.

In the present embodiment, a type of printing sheet that, for example, has a shape of "normal", a surface property of "high-quality", and furthermore has a basis weight in the range of 81 to 100 g/m$^2$ is set as "standard paper". Likewise, a type of printing sheet that has the same shape and surface property but has a basis weight in the range of 101 to 200 g/m$^2$ is set as "thick paper". The printer engine 150 may control parameters in a printing control process, such as a printing speed, a fixing temperature, and so on, in accordance with the sheet type set as shown in FIG. 3.

FIG. 4 is an example of information regarding printing functions that correspond to the sheet size and the sheet type set in the printing apparatus 110. This information is stored in the ROM 112 or the HDD 115, and is read out to the RAM 113 and used by the CPU 114 as necessary. Here, for example, whether or not double-sided printing is possible, the sheet feed tray (sheet feed source) from which sheets can be fed, the discharge destination where sheets can be discharged, and functions of a finishing device are set for each combination of sheet size and sheet type; however, the present invention is not limited to only the information shown in FIG. 4.

In the present embodiment, when the printing sheet has, for example, a sheet size of "A4" and a sheet type of "thick paper", double-sided printing is not possible, the sheets can be fed from any of the sheet feed trays, and a case-binding device and a trimming device cannot be used as the discharge destination. Here, double-sided printing is not possible because printing sheets having a high basis weight are thick, and thus the printing sheets cannot be inverted within the printer engine 150. In other words, double-sided printing is not possible due to physical restrictions of the apparatus. For the same reason, double-sided printing is not possible for "coated paper 2" and "tabbed paper 2", which have a high basis weight. Note that the information shown in FIG. 3 and FIG. 4 is preliminarily set in an unchangeable state in the printing apparatus 110 when the product is shipped, and is therefore information that the user cannot change.

FIG. 5 is a diagram illustrating an example of the sheet information, registered in the media library 204, that is set and managed in the printing apparatus 110. The media library 204 corresponds to a list of sheet information regarding individual printing sheets, is stored in the ROM 112 or the HDD 115, and is read out to the RAM 113 and used by the CPU 114 as necessary. Information set in the printing apparatus 110 in advance, as well as information that is registered by a user and will be mentioned later, are included in the media library 204 as the sheet information. In FIG. 5, for example, information indicating properties of the printing sheet, such as a name, attributes, basis weight, surface property, and color of the printing sheet, are registered in the media library 204 as the sheet information. Furthermore, information indicating printing conditions, which will be mentioned later, is registered in the media library 204 in association with the information indicating the properties of the printing sheet as the sheet information. However, the sheet information is not limited only to the information shown in FIG. 5.

The "attributes" of the printing sheet indicates whether the sheet information is information regarding printing sheets set in advance in the printing apparatus 110 ("basic sheet") or information regarding printing sheets registered as desired by the user ("user-designated"), and is information that makes it possible to distinguish between the two. The "basis weight" and the "surface property" are the same as in FIG. 3. The "conditions" indicate the printing conditions set by the user, which will be mentioned later. Note that "color" indicates the tone of the printing sheet, such as white, cream, clear, and in the case of colored paper, red, yellow, and the like, as shown in FIG. 5.

The user can set the sheet information regarding the printing sheet he or she wishes to use as desired via the sheet registration setting unit 205, and can register the set information in the media library 204 as well as change or delete registered information. However, the specifications are such that the information of printing sheets registered as "basic sheets" cannot be deleted by the user.

(Example of Sheet Information Settings)

Figure 6:
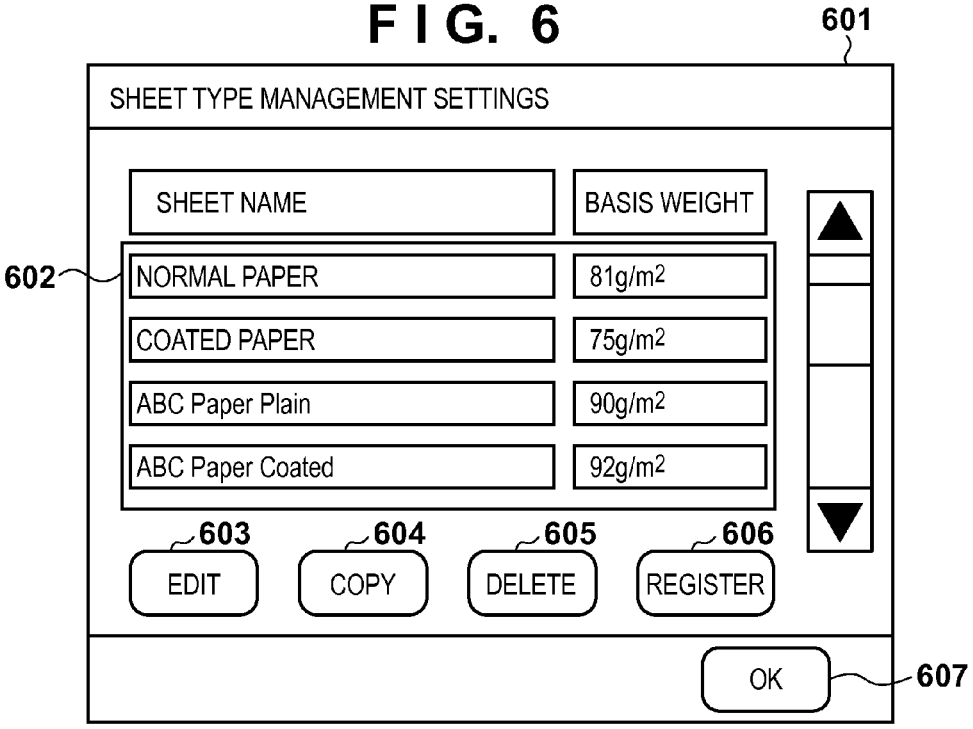
FIG. 6 is a diagram illustrating an example of a top screen in a menu for managing and setting printing sheet types.
Figure 7:
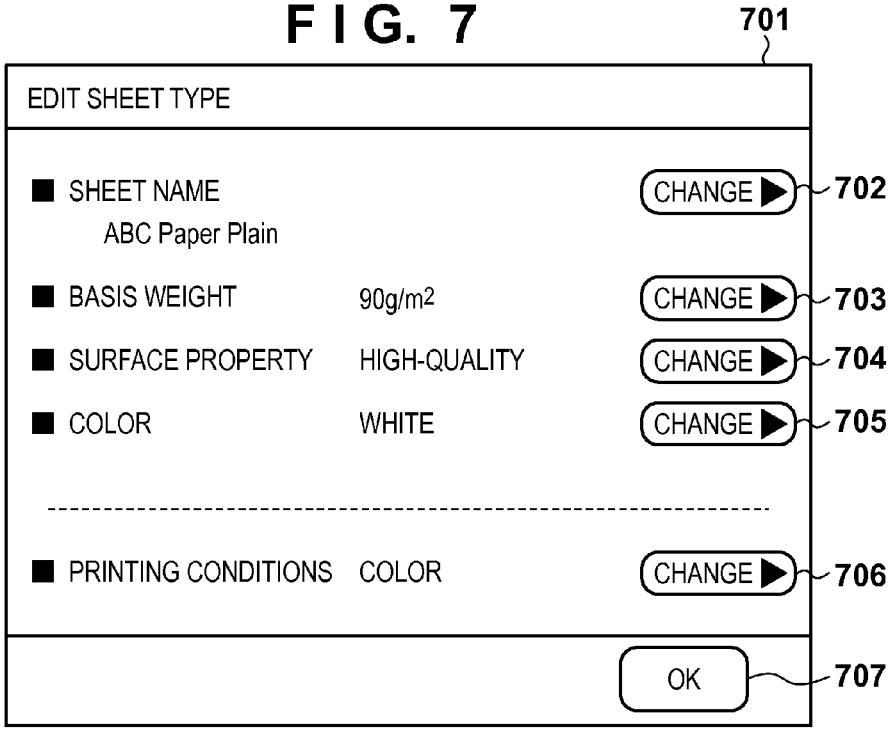
FIG. 7 is a diagram illustrating an example of a settings screen for editing sheet types.
Figure 8:
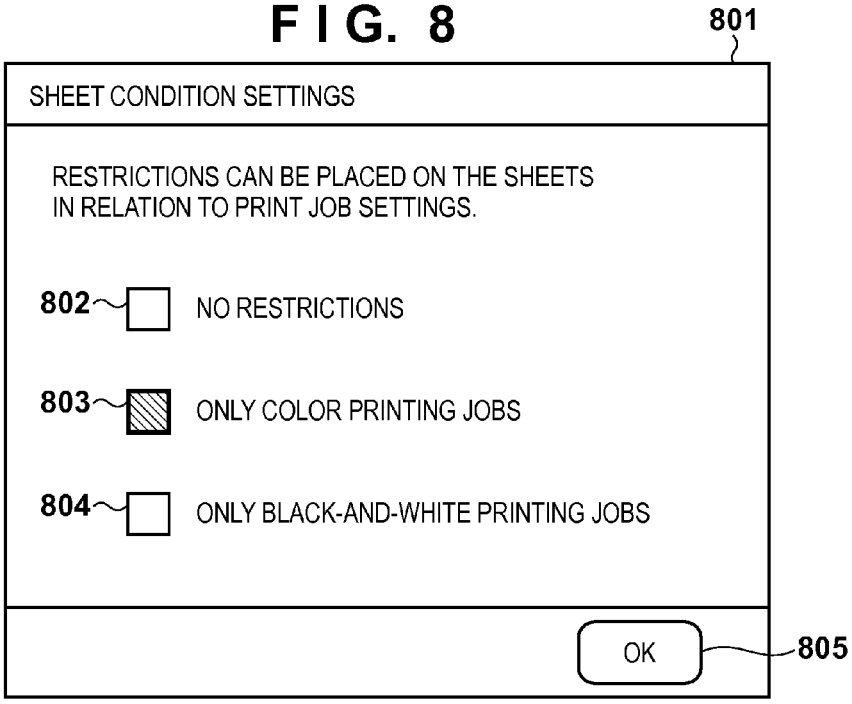
FIG. 8 is a diagram illustrating an example of a settings screen for setting sheet conditions.

FIGS. 6 through 8 are examples of menu screens through which the user sets the sheet information for the printing sheets, via the sheet registration setting unit 205. These menu screens are displayed in, for example, the operation panel 120, and are manipulated by the user. However, the configuration may be such that the operations can be made from the external terminal 101 via an external interface (not shown).

FIG. 6 is a diagram illustrating an example of a top screen of a menu for managing and setting the type of the printing sheet. When the user presses a button for moving from the menu screen (not shown) or the like to a sheet type management/settings screen, the CPU 114 displays a management/settings screen 601 in the operation panel 120.

The information of the printing sheets currently registered in the media library 204 is displayed as a list in a list 602. Here, a sheet name and basis weight are displayed as an example. The information to be displayed in the list 602 may be set to be changeable by the user via the operation panel 120. Note that in FIG. 6, only some of the information registered in the media library 204 is displayed, as an example. However, all of the information of the printing sheets included in the media library 204 may be displayed, or it may be possible to further display other information of the printing sheets. For example, only information regarding the printing sheets that are "user-designated" may be displayed in the list 602.

A button 603 is a button for editing the information regarding the printing sheets. A button 604 is a button for copying information regarding the printing sheets and adding new information regarding the printing sheets. A button 605 is a button for deleting information regarding the printing sheets that is registered in the media library 204. A button 606 is a button for newly registering information regarding the printing sheets via the sheet registration setting unit 205, as will be described later. As will also be described later, information regarding the printing sheets can be registered for a desired sheet feed tray by the user performing operations using the button 606. A button 607 is a button for ending the management and settings of the sheet types. When the button 607 is pressed by the user, the CPU 114 closes the management/settings screen 601 and displays the original menu screen in the operation panel 120.

FIG. 7 is a diagram illustrating an example of a settings screen for editing sheet types. When the user presses the edit button 603, the CPU 114 displays a sheet type editing screen 701 in the operation panel 120. Here, the sheet name, basis weight, surface property, color, and printing conditions are displayed as an example.

When the user presses any of the change buttons 702 to 706, the CPU 114 displays an editing (change) screen for the setting items corresponding to the button that has been pressed. When a change button 702 for changing the sheet name is pressed, a text input window (not shown) is displayed, and the sheet name is changed by accepting the input of desired characters through that window. When a change button 703 for changing the basis weight is pressed, a numerical value input window (not shown) is displayed, and the basis weight is changed by accepting the input of a desired numerical value through that window. When a change button 704 for changing the surface property is pressed, a settings change window (not shown) is displayed, and the surface property is changed by accepting a change in the surface property through that window. When a change button 705 for changing the color is pressed, a settings change window (not shown) is displayed, and the color is changed by accepting a change in the color through that window.

FIG. 8 is a diagram illustrating an example of a settings screen for setting conditions of the sheet (that is, for setting a printing conditions regarding printing using the sheet). When the user presses a change button 706 for changing the printing conditions, the CPU 114 displays a sheet conditions settings screen 801 in the operation panel 120. In the conditions settings screen 801, it is possible to set printing conditions for placing restrictions on the use of printing sheets, in accordance with the details of the printing settings included in a print job inputted by the user and analyzed by the print job analyzing unit 201. In the present embodiment, permitting multicolor printing only, permitting black-and-white printing only, or permitting both multicolor printing and black-and-white printing can be set as the printing conditions for the printing sheets via the conditions settings screen 801.

Check boxes 802 to 804 are used for designating respective states that place printing restrictions. The check box 802 is used to designate a state in which no restrictions related to print job settings are made (that is, both multicolor printing and black-and-white printing are permitted). A check box 803 is used for designating a state that permits the use of the printing sheets only in the case of a print job that carries out color printing (multicolor printing). A check box 804 is used for designating a state that permits the use of the printing sheets only in the case of a print job that carries out monochrome printing (black-and-white printing). A button 805 is used for ending the sheet condition settings. When the user presses the button 805, the CPU 114 updates the information included in the media library 204, closes the conditions settings screen 801, and displays the management/settings screen 601.

As will be described later using FIG. 9, in the printing apparatus 110, the printing conditions set in this manner are associated with the sheet feed tray that contains the printing sheets corresponding to those printing conditions. This is carried out by assigning the sheet information including those printing conditions to the sheet feed tray that contains the printing sheets corresponding to that sheet information. In this manner, the printing apparatus 110 sets the printing conditions for the printing sheets that are contained therein on a sheet feed tray-by-sheet feed tray basis. In the case where the printing settings, extracted from an input print job, for printing in accordance with that print job match the printing conditions set for any of the sheet feed trays, the printing apparatus 110 uses the sheet feed tray for which those printing conditions are set as the sheet feed source for the printing sheets.

In the present embodiment, it is possible to set permitting only multicolor printing and only black-and-white printing for the printing sheets as the printing conditions for the respective sheet feed trays 1 to 6 by using the conditions settings screen 801. In addition, it is possible to set permitting both multicolor printing and black-and-white printing for the printing sheets contained in the respective sheet feed trays 1 to 6 as the printing conditions. Doing so avoids executing a print job including printing settings that do not match the printing conditions using the printing sheets that are contained in a sheet feed tray for which those printing conditions are set. Accordingly, the user that instructed the execution of the print job can obtain the desired printing result using the printing sheets that match the printing settings.

Note that the configuration may be such that other conditions can be set as the printing conditions. For example, the configuration may be such that permitting only single-sided printing, only double-sided printing, or both single-sided printing and double-sided printing can be set as the printing conditions. The same advantages as those described in the present embodiment can be achieved in such a case as well.

(Assignment of Sheet Information to Sheet Feed Tray)

Next, a process for assigning the sheet information included in the media library 204 to the sheet feed trays 1 to 6 (sheet assignment settings), executed by the sheet assignment setting unit 206 (the CPU 114) in the printing apparatus 110, will be described with reference to FIGS. 9 and 10.

Figure 9:
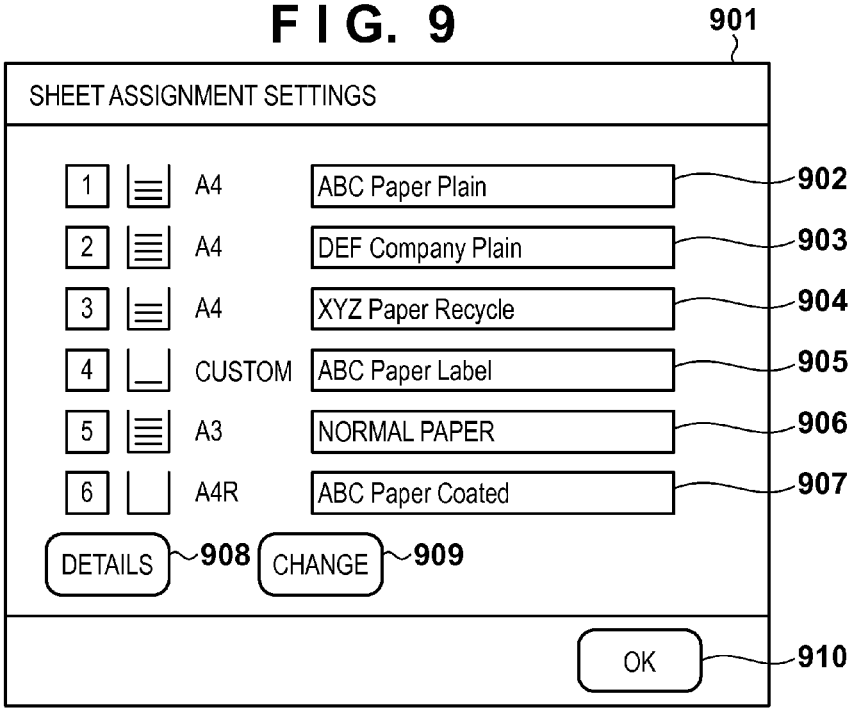
FIG. 9 is a diagram illustrating an example of a settings screen for making sheet assignment settings.

FIG. 9 is a diagram illustrating an example of a settings screen for making the sheet assignment settings. When the user presses a button for moving from the menu screen (not shown) or the like to a settings screen for the sheet assignment settings, the CPU 114 displays a settings screen 901 for the sheet assignment settings in the operation panel 120. Here, as an example, information indicating a sheet feed tray number, a remaining amount of sheets, the sheet size, and the name of the printing sheets currently assigned (registered) is displayed as a list in the settings screen 901 for each of the sheet feed trays 1 to 6 present in the sheet feeder 140. Note that other information, such as information indicating properties of the printing sheets including the basis weight and so on, may be displayed in the settings screen 901 in addition to the information shown in FIG. 9. In the case where the user adds printing sheets to a sheet feed tray, the user can, in addition to adding the printing sheets to the sheet feed tray, register the sheet information regarding the added printing sheets through the sheet assignment setting unit 206, via the settings screen 901.

Items 902 to 907 correspond to the names of the printing sheets registered in the respective sheet feed trays 1 to 6. When the user presses a details display button 908 while one of the sheet feed trays is selected, the CPU 114 displays a printing detail information screen (not shown) in the operation panel 120. The printing detail information corresponds to, for example, the printing sheet setting information illustrated in FIG. 7. A change button 909 is a button for changing the information registered for the respective sheet feed trays, and when the user presses the change button 909 while one of the sheet feed trays is selected, the CPU 114 displays, in the operation panel 120, a screen for changing the registered information. Although a method for selecting the size of the printing sheets that are added and then selecting the information regarding the printing sheets will be described as an example hereinafter, the method is not limited to this example.

Figure 10:
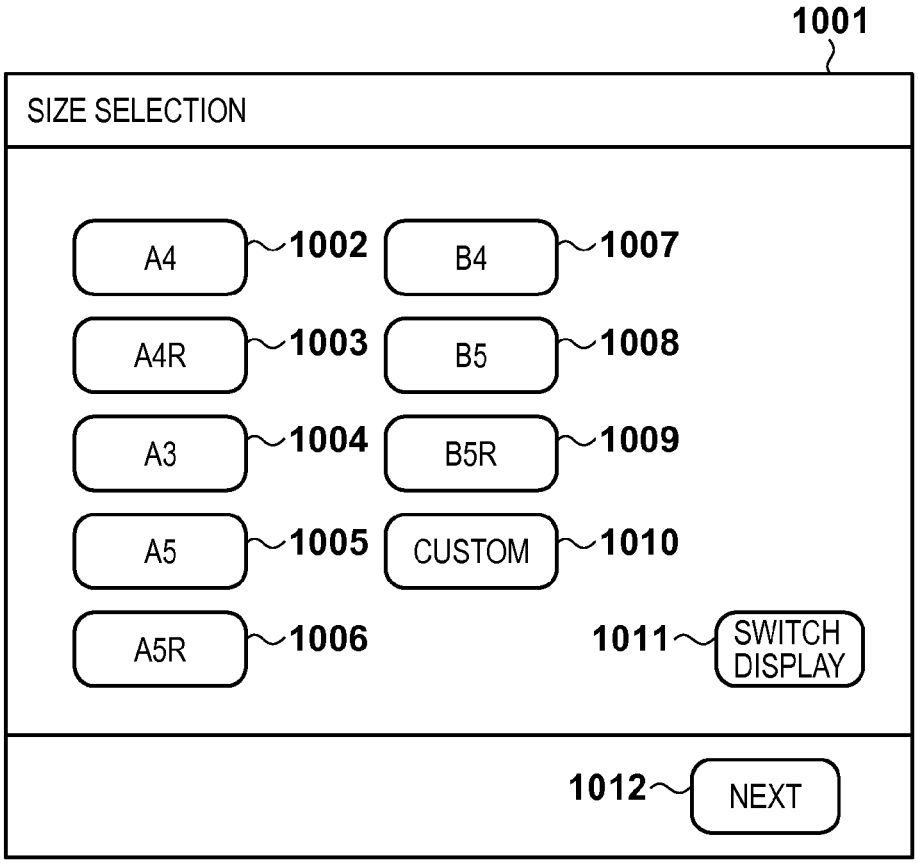
FIG. 10 is a diagram illustrating an example of a selection screen for selecting a sheet size.

FIG. 10 is a diagram illustrating an example of a selection screen for selecting the sheet size. When the change button 909 is pressed, the CPU 114 displays a sheet size selection screen 1001. Buttons 1002 to 1010 respectively correspond to different printing sheet sizes, and are used to select a corresponding sheet size. When the user presses one of the buttons 1002 to 1010, the CPU 114 sets the sheet size corresponding to the pressed button in the registered information for the corresponding sheet feed tray. When a display switch button 1011 is pressed, the display is changed from sheet sizes in millimeter units, such as "A size", "B size", and so on to sheet sizes in inch units, such as "letter", "legal", and so on. A button 1012 is used to move to the display of the next settings screen, and can be pressed once a desired sheet size has been designated.

When the button 1012 is pressed, a screen for selecting the information regarding the printing sheets is then displayed in the operation panel 120. In the present embodiment, the CPU 114 displays the management/settings screen 601 shown in FIG. 6 in the operation panel 120 as this screen. When the user selects a printing sheet and presses the register button 607 in the management/settings screen 601, the CPU 114 sets the information regarding that printing sheet (sheet information) stored in the media library 204 as the registered information for the corresponding sheet feed tray. Furthermore, the set information is displayed for the corresponding sheet feed tray in the settings screen 901 for the sheet assignment settings.

As described thus far, the CPU 114 (sheet registration setting unit 205 and sheet assignment setting unit 206) sets the printing conditions for the printing sheets contained in the respective sheet feed trays 1 to 6 on a sheet feed tray-by-sheet feed tray basis in accordance with instructions from the user (as the aforementioned registered information). Specifically, the CPU 114 stores the set printing conditions in the HDD 115 as part of the sheet information included in the media library 204, and stores that sheet information in the HDD 115 in association with the sheet feed tray that contains the corresponding printing sheets. Through this, the printing conditions corresponding to the printing sheets that are contained are stored (as the aforementioned registered information) in the HDD 115 in association with the properties of those printing sheets included in the sheet information, for the respective sheet feed trays 1 to 6.

Note that the information indicating the sheet sizes that correspond to the printing sheets contained in the sheet feed trays 1 to 6, set via the settings screen shown in FIG. 10, is also included in the stated properties of the printing sheets. The CPU 114 also stores the information indicating the sheet sizes in the HDD 115 as part of the sheet information, and thus the information can be used when executing the print job. Note that the sheet sizes corresponding to the printing sheets contained in the sheet feed trays 1 to 6 may be identified by the CPU 114 in accordance with information from sheet size detection sensors provided in the sheet feed trays.

(Process for Generating Print Job in External Terminal 101)

Figure 11:
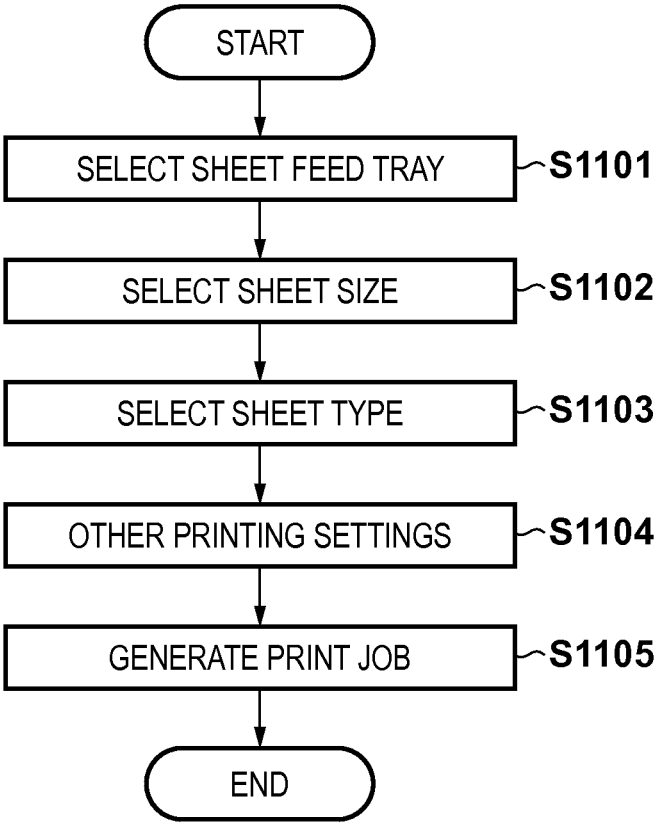
FIG. 11 is a flowchart illustrating a process for generating a print job executed by an external terminal 101 according to the first embodiment of the present invention.

Next, a process performed by the external terminal 101 for generating a print job will be described with reference to FIG. 11. The present embodiment describes a case in which the print job is generated in the external terminal 101 as an example. The processes of the respective steps shown in FIG. 11 are executed by a printer driver stored in a storage unit (not shown) of the external terminal 101.

In S1101, the printer driver accepts the selection of a sheet feed tray made by the user. Here, one of the sheet feed trays 1 to 6 that can be used in the printing apparatus 110 can be selected. Alternatively, it is also possible to designate "auto select" for automatically selecting the sheet feed tray that is to be used as the sheet feed source for the printing sheets used in the printing performed according to the print job. In S1102, the printer driver accepts the selection of the sheet size made by the user. Here, the same size as the size of the document to be printed can be selected. Alternatively, it is possible to select an arbitrary size and then enlarge or reduce the image size corresponding to the print data so that the document to be printed fits within the selected size.

In S1103, the printer driver accepts the selection of the sheet type made by the user. Here, the sheet type can be selected from among the sheet types registered for the respective sheet feed trays as shown in FIG. 9. Alternatively, it is also possible to designate "auto select" for automatically selecting the sheet type. In S1104, the printer driver accepts the designation of printing settings aside from the sheet size or the sheet type, made by the user. Here, the printer driver accepts the designation of printing settings that can be used when the printing apparatus 110 executes the print job, such as a designation of the number of copies to be printed, a designation of double-sided printing, settings for various types of image processing functions, and so on.

Finally, in S1105, the printer driver generates the print job in accordance with the respective printing settings accepted in S1101 to S1104. The printer driver then sends the generated print job from the external terminal 101 to the printing apparatus 110 via the communication line 105. Upon receiving the print job from the external terminal 101, the printing apparatus 110 causes the print job analyzing unit 201 to analyze the received print job.

(Printing Process in Printing Apparatus 110)

Figure 12:
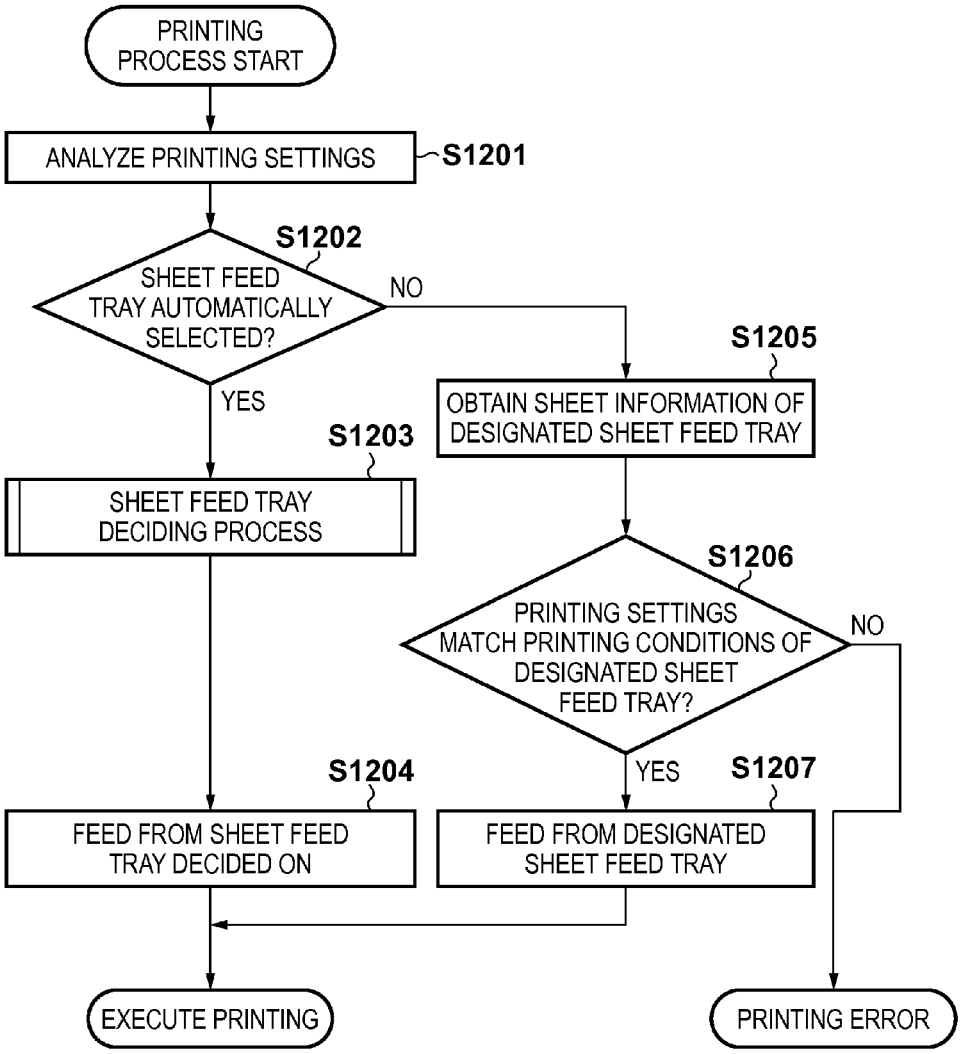
FIG. 12 is a flowchart illustrating a printing process executed by the printing apparatus 110 according to the first embodiment of the present invention.

Next, a printing process executed by the printing apparatus 110 will be described with reference to FIGS. 12 and 13. FIG. 12 is a flowchart illustrating the printing process executed by the printing apparatus 110. The printing apparatus 110 starts the printing process when a print job is input. Note that S1201 corresponds to processing performed by the print job analyzing unit 201, whereas S1202, S1203, S1205, and S1206 correspond to the processing performed by the sheet feed tray deciding unit 207.

In S1201, the CPU 114 analyzes the printing settings in the input print job. The print job analyzing unit 201 extracts, from the input print job, the printing settings for printing according to that print job. As described above, these printing settings include settings for the sheet feed source of the printing sheets (sheets) to be used in the print job. The processes described hereinafter are executed based on the respective setting values designated in the printing settings obtained as a result of the analysis performed in S1201.

In S1202, the CPU 114 determines whether or not auto select, for automatically selecting the sheet feed tray (sheet feed source), is set as the setting for the sheet feed source in the print job. In the case where auto select is set ("YES" in S1202), the CPU 114 advances the processing to S1203, where the CPU 114 decides the sheet feed tray to be used as the sheet feed source through a sheet feed tray deciding process (described later with reference to FIG. 13). Furthermore, in S1204, the CPU 114 causes the printing sheets to be supplied from the sheet feed tray decided in S1203, and causes the printer engine 150 to execute the printing process. In other words, the printer engine 150 executes the print job using the printing sheets contained in the sheet feed tray decided on in S1203.

On the other hand, in the case where one of the sheet feed trays is designated in the print job as the sheet feed tray setting in S1202 ("NO" in S1202), the CPU 114 advances the processing to S1205. In S1205, the CPU 114 obtains, from the HDD 115 (the media library 204), the sheet information regarding the printing sheets contained in the designated sheet feed tray. Furthermore, in S1206, the CPU 114 determines whether or not the printing settings analyzed in S1201 match the printing conditions corresponding to the designated sheet feed tray included in the sheet information obtained in S1205. In the present embodiment, it is determined whether or not printing color settings (that is, a designation of multicolor printing or black-and-white printing) included in the printing settings extracted in S1201 match the printing conditions set using the conditions setting screen 801 for the printing sheets contained in the designated sheet feeding tray.

In the case where the CPU 114 has determined that the printing settings match the printing conditions ("YES" in S1206), the CPU 114 advances the processing to S1207, where it decides on the designated sheet feed tray as the sheet feed source for the printing sheets. Furthermore, the CPU 114 causes the printing sheets to be supplied from the designated sheet feed tray, and causes the printer engine 150 to execute the printing process. On the other hand, in the case where the CPU 114 has determined that the printing settings do not match the printing conditions ("NO" in S1206), printing is not permitted because it is not possible to carrying out printing using the printing sheets contained in the designated sheet feed tray, and thus the CPU 114 determines that a printing error has occurred. In this case, the CPU 114 may notify the user that a printing error has occurred by, for example, displaying an error message indicating that a printing error has occurred in the operation panel 120. Here, the CPU 114 may notify the user of the printing error by displaying, in the operation panel 120, a message for notifying the user that printing cannot be carried out using the printing sheets contained in the designated sheet feed tray, or may notify the user of the printing error using audio.

Note that in the case where it has been determined in S1206 that the printing settings do not match the printing conditions ("NO" in S1206), the CPU 114 may automatically select, from the sheet feed trays aside from the designated sheet feed tray, a sheet feed tray that contains printing sheets that can be used. In other words, the CPU 114 may identify, from the sheet feed trays aside from the designated sheet feed tray, a sheet feed tray for which the set printing conditions match the printing settings and for which printing that uses the printing sheets contained therein is thus permitted, and may decide on the identified sheet feed tray as the sheet feed source. Through this, even in the case where the printing conditions that correspond to the designated sheet feed tray do not match the printing settings, another sheet feed tray can be automatically selected, and a printing result obtained by executing the desired printing settings can be achieved.

(Sheet Feed Tray Deciding Process of S1203)

Here, the sheet feed tray deciding process executed by the CPU 114 (the sheet feed tray deciding unit 207) in S1203 will be described with reference to FIG. 13. In S1203, the CPU 114 identifies, from the sheet feed trays 1 to 6, a sheet feed tray for which the printing settings included in the print job match the set printing conditions and for which printing that uses the printing sheets contained therein is thus permitted, and decides on the identified sheet feed tray as the sheet feed source.

Specifically, first, in S1301, the CPU 114 selects one of the sheet feed trays 1 to 6 as a candidate for a first sheet feed tray. Then, in S1302, the CPU 114 determines whether or not the properties of the printing sheets included in the sheet information registered for the selected sheet feed tray match the properties of the printing sheets set in the printing settings of the print job. In other words, the CPU 114 determines whether or not printing sheets having the properties set in the printing settings are contained in the selected sheet feed tray. In the case where the CPU 114 has determined that the printing sheet properties match in S1302 ("YES" in S1302), it advances the processing to S1303, whereas in the case where it has determined that the printing sheet properties do not match ("NO" in S1302), it advances the processing to S1305.

Note that in S1302 (and S1303), the CPU 114 refers to the HDD 115 (media library 204), reads out the sheet information corresponding to the selected sheet feed tray, and makes the determination using the printing sheet properties and printing conditions included in the read-out sheet information. Meanwhile, in the present embodiment, the determination made in S1302 uses the sheet size and the sheet type as the printing sheet properties, and whether or not both of those properties match is determined.

In S1303, the CPU 114 determines whether or not the printing settings match the (set) printing conditions that correspond to the selected sheet feed tray, and based thereon, determines whether or not printing that uses the printing sheets contained in that sheet feed tray is permitted. In the case where the CPU 114 has determined that the printing settings match the printing conditions ("YES" in S1303), it advances the processing to S1304, where it decides on the identified sheet feed tray on as the sheet feed source. On the other hand, in the case where the CPU 114 has determined that the printing settings do not match the printing conditions ("NO" in S1303), it advances the processing to S1305.

When the processing advances from S1302 or S1303 to S1305, the CPU 114 determines that the use of the printing sheets contained in the selected sheet feed tray is not suited to the execution of the print job, and determines whether or not another selectable sheet feed tray that is different from the selected sheet feed tray is present. In the case where it has been determined that another selectable sheet feed tray is not present ("NO" in S1305), the CPU 114 notifies the user of a printing error by, for example, displaying a message indicating that a printing error has occurred in the operation panel 120. The execution of the print job ends thereafter. Here, the CPU 114 may notify the user of the printing error by displaying, in the operation panel 120, a message for notifying the user that there are no printing sheets that match the printing, or may notify the user of the printing error using audio.

On the other hand, in the case where it has been determined that another sheet feed tray is present ("YES" in S1305), the CPU 114 advances the processing to S1306, selects the next sheet feed tray, and executes the processing from S1302 on once again. Through this, it is determined whether or not the use of the printing sheets held in the next sheet feed tray is suited to the execution of the print job. A sheet feed tray that holds printing sheets that can be used in the execution of the print job is identified by repeating this processing for each of the sheet feed trays.

(Example of Execution of Printing Process)

In the present embodiment, as described above, permitting multicolor printing only, permitting black-and-white printing only, or permitting both multicolor printing and black-and-white printing can be set as the printing conditions for the printing sheets held in the respective sheet feed trays. Hereinafter, an example of a printing process based on the stated printing conditions will be described. Note that the sheet information including the printing conditions for the respective printing sheets is configured of the information shown in FIG. 5, and is assumed to be held in the media library 204. In addition, it is assumed that the printing conditions are set for each sheet feed tray by assigning the sheet information shown in FIG. 9 to the respective sheet feed trays 1 to 6.

First, a case in which the printing settings extracted from the input print job include the following settings will be assumed.

sheet feed source: "auto select"
sheet size: "A4"
sheet type: "ABC Paper Plain"
printing color: "multicolor printing"

Figure 13:
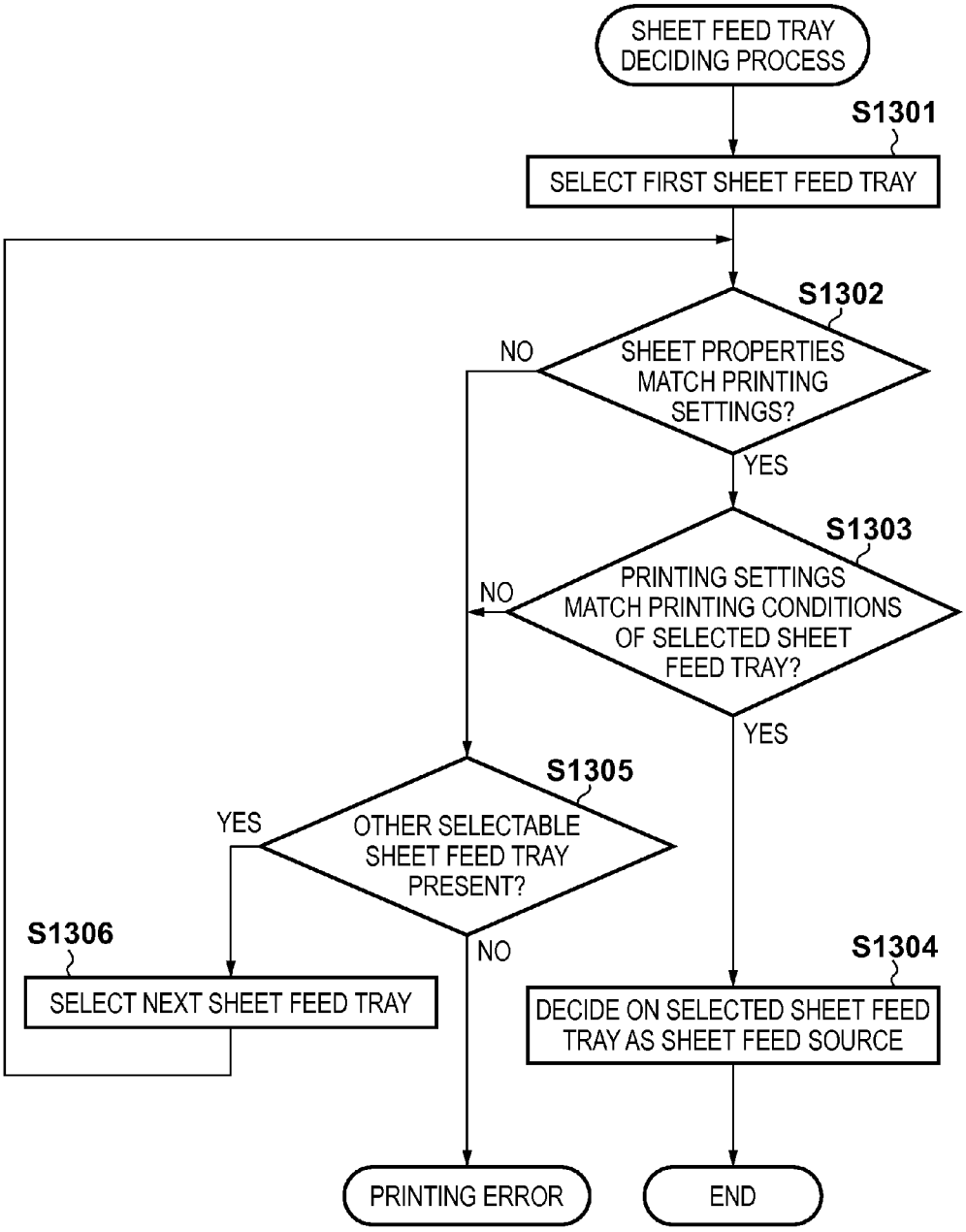
FIG. 13 is a flowchart illustrating a process for deciding on a sheet feed tray executed by the printing apparatus 110 according to the first embodiment of the present invention.

In the case described above, the CPU 114 determines that "auto select" is set for the print job ("YES" in S1202), and executes the processing of S1203 (FIG. 13). Meanwhile, the CPU 114 determines that the properties of the printing sheets registered for the sheet feed tray 1 (sheet size: "A4", sheet type: "ABC Paper Plain") match the stated printing settings extracted from the print job ("YES" in S1302). Here, permitting only multicolor printing is set in the printing conditions for the sheet feed tray 1 ("ABC Paper Plain" in FIG. 5). Accordingly, the CPU 114 determines that the printing settings extracted from the print job match the printing conditions that correspond to the sheet feed tray 1 ("YES" in S1303). As a result, the print job is executed using the printing sheets held in the sheet feed tray 1.

Note that in the case where "black-and-white printing" is set in the aforementioned printing settings as the setting for the printing color, the CPU 114 determines that the printing settings do not match the printing conditions corresponding to the sheet feed tray 1 ("NO" in S1303). In this case, the sheet feed tray 1 is not decided on as the sheet feed source. Ultimately, the user is notified that a printing error has occurred, without any of the sheet feed trays 1 to 6 being decided on as the sheet feed source.

Next, a case in which the printing settings extracted from the input print job include the following settings will be assumed.

sheet feed source: "sheet feed tray 1"

printing color: "black-and-white printing"

In the case described above, the CPU 114 determines that "auto select" is not set for the print job ("NO" in S1202), and executes the processing of S1205 and on. The CPU 114 obtains the sheet information of the printing sheets registered for the sheet feed tray 1 (that is, the printing conditions) (S1205). Here, permitting only multicolor printing is set in the printing conditions for the sheet feed tray 1 ("ABC Paper Plain" in FIG. 5). Accordingly, the CPU 114 determines that the printing settings extracted from the print job do not match the printing conditions that correspond to the sheet feed tray 1 ("NO" in S1206). As a result, the user is notified that a printing error has occurred, without the sheet feed tray 1 being decided on as the sheet feed source.

Note that in the case where "multicolor printing" is set in the aforementioned printing settings as the setting for the printing color, the CPU 114 determines that the printing settings match the printing conditions corresponding to the sheet feed tray 1 ("YES" in S1206). In this case, the print job is executed using the printing sheets held in the sheet feed tray 1.

As described thus far, the printing apparatus according to the present embodiment sets printing conditions, which specify conditions for permitting printing using printing sheets contained in each of a plurality of sheet feed trays, for each of the sheet feed trays, in accordance with instructions made by a user. When "auto select" is set for a sheet feed source in printing settings extracted from an input print job, the printing apparatus decides on a sheet feed tray, from the plurality of sheet feed trays, for which printing using the printing sheets contained therein is permitted as the sheet feed source, based on the set printing conditions. Specifically, a sheet feed tray for which printing using the printing sheets contained therein is permitted due to the fact that the printing settings extracted from the print job match with the set printing conditions is decided on as the sheet feed source. Furthermore, the printing apparatus executes the print job using the printing sheets contained in the sheet feed tray that has been decided on.

According to the present embodiment, it is possible for a printing apparatus to more appropriately select a sheet feed tray that corresponds to printing settings and execute a print job, even in the case where the sheet feed unit (sheet feed tray) is automatically selected. Specifically, in the case where the printing settings of a print job do not match the printing conditions for printing sheets set in advance for a sheet feed tray, a sheet feed tray that corresponds to the printing settings can be selected, as the sheet feed source, from sheet feed trays aside from the sheet feed tray for which those printing conditions are set. Furthermore, by setting, for the printing sheets contained in the sheet feed trays, the printing conditions to avoid printing settings in which the execution of the printing is restricted due to the structure of the printing apparatus, the use of printing sheets that are not suited to the execution of the print job can be avoided automatically. This enables the sheet feed tray corresponding to the printing settings to be more appropriately selected to execute the print job.

Second Embodiment

The first embodiment describes, with reference to FIG. 8 and the like, a method for setting printing conditions that can be used in the aforementioned S1206 and S1303. However, depending on the printing conditions that are set, there may be cases where the printing cannot actually be executed in accordance with the printing conditions, even in the case where the printing settings included in the print job match the printing conditions. For example, in the case where multicolor printing is permitted in accordance with the printing conditions, if the printing sheets contained in the sheet feed tray that corresponds to those printing conditions are printing sheets that are in actuality not suited for multicolor printing, the multicolor printing ultimately cannot be executed using those printing sheets.

The second embodiment makes it possible to more appropriately set the printing conditions by ensuring that such mistaken settings are not made when setting the printing conditions corresponding to the respective sheet feed trays (the sheet feed trays 1 to 6) provided in the printing apparatus. Note that the following descriptions will be simplified by omitting descriptions of areas that are the same as in the first embodiment.

Figure 14:
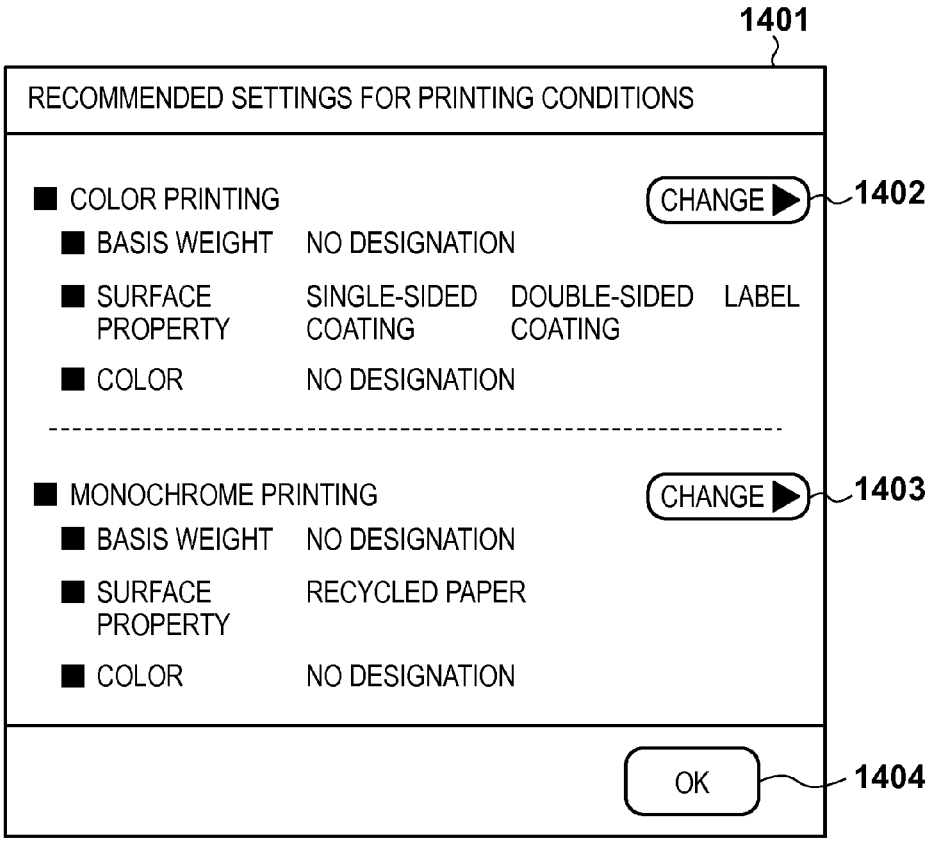
FIG. 14 is a diagram illustrating an example of a settings screen regarding recommended settings for printing conditions.

FIG. 14 is a diagram illustrating an example of a settings screen regarding recommended settings for printing conditions. The CPU 114 displays a settings screen 1401, shown in FIG. 14, in the operation panel 120 in the case where, for example, a settings button (not shown) provided in the management/settings screen 601 has been pressed.

In the settings screen 1401, for example, properties of the printing sheets suited to printing can be designated as recommended settings used when setting the printing conditions, for printing conditions regarding color printing (multicolor printing) and regarding monochrome printing (black-and-white printing). When a change button 1402 or 1403 is pressed in the settings screen 1401, a settings menu (not shown) is displayed. Information indicating properties of the printing sheets, such as, for example, a range for the basis weight of the printing sheets, a surface property, and a color, can be designated through this settings menu. In the settings screen 1401, printing sheets having a surface property of "single-sided coating", "double-sided coating", or "label" are set as the recommended settings corresponding to color printing. Meanwhile, printing sheets having a surface property of "recycled paper" are set for the recommended settings corresponding to monochrome printing.

When the settings of the recommended settings for the printing conditions are finished in the settings screen 1401 and an OK button 1404 is pressed, the CPU 114 saves the set information by storing that information in the HDD 115 (media library 204).

Figure 15:
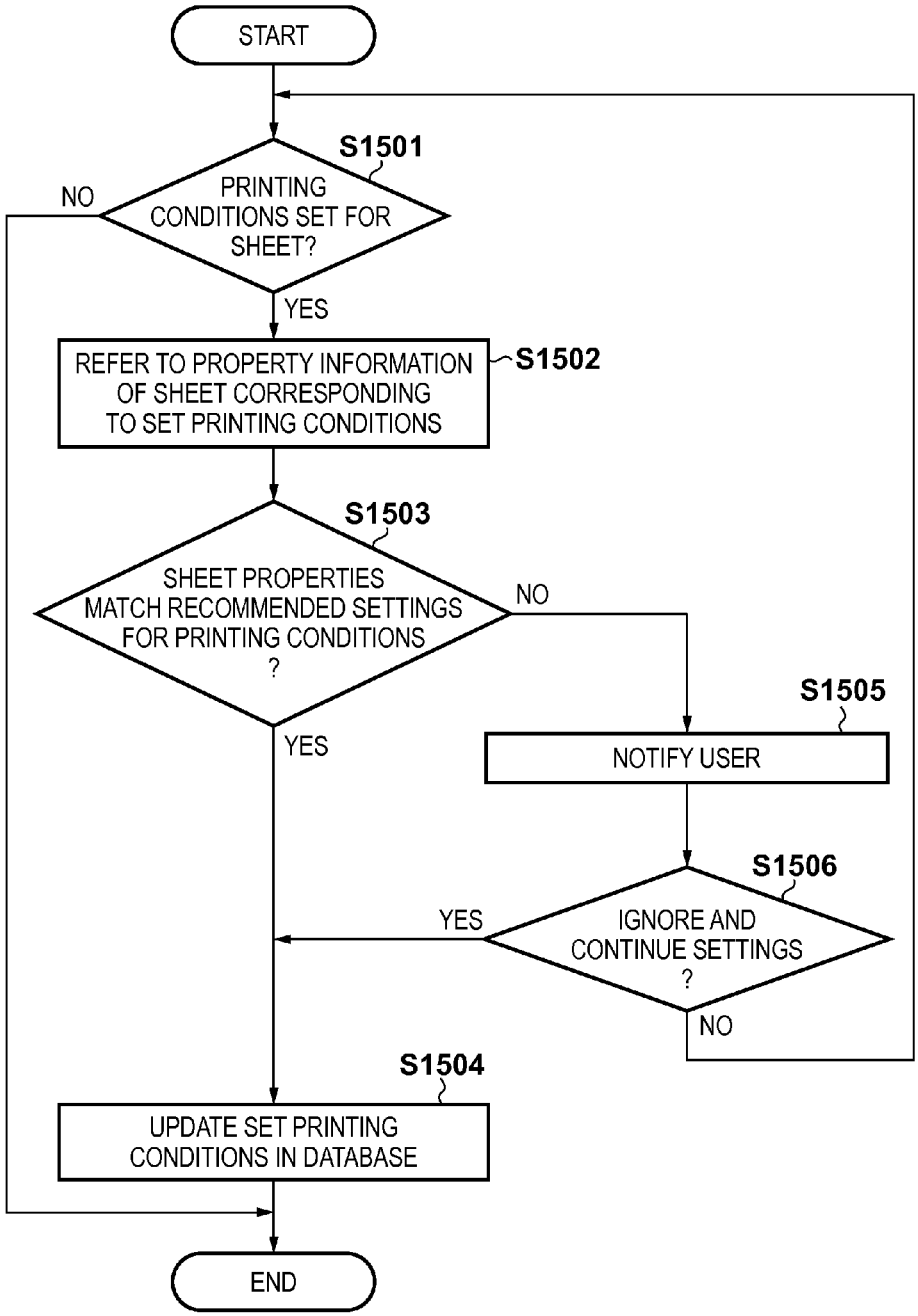
FIG. 15 is a flowchart illustrating a process for setting printing conditions executed by the printing apparatus 110 according to a second embodiment of the present invention.

Next, a process for setting the printing conditions executed by the printing apparatus 110 according to the present embodiment will be described with reference to FIG. 15. The following assumes that the printing conditions for the printing sheets are set via the conditions settings screen 801 shown in FIG. 8, as described in the first embodiment.

First, in S1501, the CPU 114 (sheet registration setting unit 205) determines whether or not printing conditions have been set for the corresponding printing sheets via the conditions settings screen 801 using the operation panel 120. In the case where the CPU 114 has determined that the printing conditions have been set using the conditions settings screen 801 ("YES" in S1501), the processing is advanced to S1502, whereas when such is not the case ("NO" in S1502), the processing ends.

In S1502, the CPU 114 refers to the HDD 115 (media library 204), and in the case where the printing conditions are set, the CPU 114 obtains property information indicating properties of the printing sheets that correspond to the set printing conditions. Furthermore, in S1503, the CPU 114 determines whether or not the properties of the printing sheets that correspond to the set printing conditions match the recommended settings set via the settings screen 1401. In this manner, the CPU 114 determines whether or not printing can be executed on the printing sheets in accordance with the set printing conditions based on the properties of the printing sheets.

In the case where it has been determined that the properties of the printing sheets do not match the recommended settings ("NO" in S1503), the CPU 114 determines that printing cannot be executed on the printing sheets in accordance with the set printing conditions, and advances the processing to S1505. However, in the case where it has been determined that the properties of the printing sheets match the recommended settings ("YES" in S1503), the CPU 114 determines that printing can be executed on the printing sheets in accordance with the set printing conditions, and advances the processing to S1504. Lastly, in S1504, the CPU 114 updates the set printing conditions in the HDD 115 (media library 204).

In the case of the processing has advanced from S1503 to S1505, it is possible that the user has set erroneous printing conditions. In this case, in S1505, the CPU 114 notifies the user of the result of the determination made in S1503. Specifically, the CPU 114 notifies the user that it is possible that erroneous printing conditions are set, and also notifies the user that printing cannot be executed on the printing sheets in accordance with the set printing conditions.

Furthermore, in S1506, the CPU 114 determines, based on an instruction from the user, whether or not to ignore the result of the determination made in S1503 and continue setting the printing conditions. In the case where, for example, the user has instructed the setting of the printing conditions to continue via the operation panel 120 in S1506, the CPU 114 determines the setting of the printing conditions is to be continued as-is ("YES" in S1506), and advances the processing to S1504. On the other hand, in the case where, for example, the user has instructed the settings of the printing conditions to be changed, the CPU 114 determines that the setting of the printing conditions is not to be continued ("NO" in S1506), and returns the processing to S1501. In S1501, the CPU 114 once again displays the conditions settings screen 801 in the operation panel 120, and accepts the setting of the printing conditions.

For example, printing sheets having a name of "XYZ Paper Recycle" are, as shown in FIG. 5, registered in the media library 204 as printing sheets having a surface property of "recycled paper". A case in which "only color print jobs" is set as the printing conditions for these printing sheets using the conditions settings screen 801 can be considered. Here, in the case where the recommended settings are set as indicated in FIG. 14 (the settings screen 1401), it can be seen that "recycled paper" is a printing sheet property recommended only for monochrome printing. Accordingly, in this case, it is determined that the printing sheet properties do not match the recommended settings for the printing conditions ("NO" in S1503). As a result, the user notification is carried out in S1505.

As described thus far, the printing apparatus according to the present embodiment determines whether or not set printing conditions match pre-set recommended settings when setting printing conditions for printing sheets. Through this, the printing apparatus determines whether or not printing can actually be executed on the printing sheets contained in the corresponding sheet feed tray in accordance with the set printing conditions. The printing apparatus furthermore notifies the user of the result of that determination.

According to the present embodiment, in addition to the same advantages as those in the first embodiment, the user can be more appropriately prompted to set the printing conditions when setting the printing conditions for the respective sheet feed trays (sheet feed trays 1 to 6) provided in the printing apparatus. Through this, it is possible to prevent erroneous printing conditions from being set.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-135125, filed Jun. 14, 2012, which is hereby incorporated by reference herein in its entirety.

What is claimed is:

1. A printing apparatus capable of feeding sheets from a plurality of sheet feed units, the apparatus comprising:

a setting unit configured to set a printing condition, which specifies a condition for permitting printing using a sheet, for that sheet in accordance with an instruction from a user;

an extracting unit configured to extract, from a print job, printing settings including a setting regarding a sheet to be used in the print job;

a deciding unit configured to decide on a sheet feed unit, from the plurality of sheet feed units, for which printing using the sheet contained in the sheet feed unit is permitted, as a sheet feed source, based on the printing condition and the printing settings; and an executing unit configured to execute the print job using the sheet contained in the sheet feed unit that has been decided on.

2. The printing apparatus according to claim 1, wherein:

the printing settings include a setting regarding a property of the sheet to be used in the print job;

the setting unit sets the printing condition for the sheets contained in each of the plurality of sheet feed units, and stores the set printing condition in a storage unit of the printing apparatus in association with the property of the sheet; and the deciding unit refers to the storage unit, and decides on, as the sheet feed source, the sheet feed unit that contains the sheet having the property set for the printing settings and for which printing using the sheet contained therein is permitted due to the printing settings matching the printing condition.

3. The printing apparatus according to claim 2, wherein the property includes at least one of a sheet type, a sheet size, a sheet color, a sheet surface property, and a sheet basis weight.

4. The printing apparatus according to claim 1, wherein the setting unit sets, as the printing condition for the sheet, that only multicolor printing, only black-and-white printing, or both multicolor printing and black-and-white printing is to be permitted.

5. The printing apparatus according to claim 1, wherein the setting unit sets, as the printing condition for the sheet, that only single-sided printing, only double-sided printing, or both single-sided printing and double-sided printing is to be permitted.

6. The printing apparatus according to claim 1, wherein in a case where one of the plurality of sheet feed units is designated as a setting for the sheet feed source and the printing settings match the printing condition corresponding to the designated sheet feed unit, the deciding unit decides on the designated sheet feed unit as the sheet feed source.

7. The printing apparatus according to claim 6, wherein in a case where one of the plurality of sheet feed units is designated as a setting for the sheet feed source and the printing settings do not match the printing condition corresponding to the designated sheet feed unit, the deciding unit identifies, from sheet feed units aside from the designated sheet feed unit, a sheet feed unit for which printing using the sheet contained therein is permitted due to the printing settings matching the printing condition, and decides on the identified sheet feed unit as the sheet feed source.

8. The printing apparatus according to claim 1, further comprising:

a notification unit configured to determine whether or not printing according to the printing condition set through the setting unit can be executed on a sheet contained in the sheet feed unit corresponding to the printing condition, and, in a case where it has been determined that the printing cannot be executed on the sheet, notify the user of the result of the determination.

9. A control method for a printing apparatus capable of feeding sheets from a plurality of sheet feed units, the method comprising:

setting a printing condition, which specifies a condition for permitting printing using a sheet, for that sheet in accordance with an instruction from a user;

extracting, from a print job, printing settings including a setting regarding a sheet to be used in the print job;

deciding on a sheet feed unit, from the plurality of sheet feed units, for which printing using the sheet contained in the sheet feed unit is permitted, as the sheet feed source, based on the printing condition and the printing settings; and executing the print job using the sheet contained in the sheet feed unit that has been decided on.

10. A non-transitory, computer-readable storage medium storing a computer program for causing a computer to execute steps of a control method for a printing apparatus capable of feeding sheets from a plurality of sheet feed units, the method comprising steps of:

setting a printing condition, which specifies a condition for permitting printing using a sheet, for that sheet in accordance with an instruction from a user;

extracting, from a print job, printing settings including a setting regarding a sheet to be used in the print job;

deciding on a sheet feed unit, from the plurality of sheet feed units, for which printing using the sheet contained in the sheet feed unit is permitted, as the sheet feed source, based on the printing condition and the printing settings; and executing the print job using the sheet contained in the sheet feed unit that has been decided on.

* * * * *